US006971126B1

(12) United States Patent
Kluckhuhn

(10) Patent No.: US 6,971,126 B1
(45) Date of Patent: Dec. 6, 2005

(54) TRANSFER SYSTEM FOR AN INVALID PATIENT

(76) Inventor: Gary R. Kluckhuhn, 2180 Sandpiper St., Naples, FL (US) 34102

( * ) Notice: Subject to any disclaimer, the term of this patent is extended or adjusted under 35 U.S.C. 154(b) by 0 days.

(21) Appl. No.: 11/009,882

(22) Filed: Dec. 13, 2004

(51) Int. Cl.[7] ..... G65G 65/02
(52) U.S. Cl. ..... 5/81.1 R; 5/83.1
(58) Field of Search ..... 5/81.1 R, 83.1; 198/321; 414/528–529; 212/342–43; 294/67.31, 294/81.51

(56) References Cited

U.S. PATENT DOCUMENTS 2,203,204 A * 6/1940 Nicolai ..... 5/83.1

* cited by examiner

*Primary Examiner*—Heather Shackelford
*Assistant Examiner*—Fredrick Conley

(57) ABSTRACT

An invalid person transfer system that has a rectangular frame suspended from a dolly moving on a track on the ceiling. There are left and right support columns that have gear boxes attached to their lower ends. The gear boxes each have at their ends attached thereto pivotal frame members that are connected to each other by a multiple of connecting rods. From the gear boxes conveyor belts are driven to front rollers that form a forward edge between the pivotal frame members in a return manner. The conveyor belts can be driven by either belt drives or gear drives from the gear boxes. In operation, a patient sits on a support and the fronts of each of the frame members move under the patients assisted by the conveyor belts from each side. When the fronts of the frame members are in a close proximity, the patient is sitting on the conveyor belts and then be transported or transfer to a different location without any assistance from an attendant.

9 Claims, 5 Drawing Sheets

TRANSFER SYSTEM FOR AN INVALID PATIENT

BACKGROUND OF THE INVENTION

The invention relates to a transfer system that uses conveyor belts and other conveyances. Particularly, the system relates to a device for lifting and moving a recumbent or sitting person from one location A to another location B. Many sick or disabled persons are unable to get up by themselves and move to another location and require the assistance of an attendant. For moving such a person, it is ordinarily necessary for the attendant to pick up the person in his or her arms, although there are also available on the market suspension devices for lowering a recumbent person and for transferring such a person to another bed, a wheelchair or bathing facilities.

When a person to be moved is an adult, the method of moving him or her by picking him up directly in the arms is very hard work and has to be done while standing in a posture that is unnatural for lifting so that the attendant, who frequently has to move such a person is likely to suffer from back pain. This has been a very serious problem at hospitals and other facilities where bedridden persons are cared for.

DISCUSSION OF THE PRIOR ART

U.S. Pat. No. 3,150,757 shows a moving sidewalk using two opposed belts having upper and lower runs operating in opposite directions while both inner runs are contiguous to each other and running in the same direction. This basic principle is used in the invention at hand.

U.S. Pat. No. 3,418,670 discloses opposing belts by using a small upper roller assembly that is disposed for receiving a patient onto a stretcher as the stretcher moves under the patient. A crank arm turns a worm gear to drive the lower belt which then drives the upper belt by frictional engagement therewith.

U.S. Pat. No. 3,608,104 illustrates a carrying assembly to lift and transport disabled person. The device includes two lateral plates which are moved toward each other and under a patient who remains in a seated position.

U.S. Pat. No. 3,854,152 shows a patient transfer device which includes two roller supported endless belts disposed one above the other. The lower endless belt drives both belts toward a patient while the upper endless belt is moving in the opposite direction via drive means attached to the plurality of rollers.

U.S. Pat. No. 4,680,818 shows a device for moving a recumbent person which includes a base plate, an insertion plate and a pair of rollers having a belt trained around the same which belt can be wound to and from each of the rollers while the belt is trained around the base plate.

U.S. Pat. No. 5,283,917 shows a device for lifting or positioning a person which device includes a base, a multiplicity of supporting elements for the body of the person and a positioning device connecting the base to the supporting elements. The device does not use any opposing belts.

U.S. Pat. No. 5,411,279 discloses a multiple belt conveying device that includes at least one endless inner belt which is movably wound on at least one substrate plate and further is included is an outer endless belt movably mounted on a front roller. The outer belt movably overlaps the front roller with inner surface of the outer belt and frictionally contacting the outer frictionally surface of the inner belt.

U.S. Pat. No. 5,540,321 shows the use of opposing belts as a means for moving objects. An upper and a lower endless belt each are trained around a pair of rollers while the inner surface of the upper belt and the upper surface of the inner belt are in contact with each other and are moving in unison when one roller is driven in either direction.

U.S. Pat. No. 5,946,748 discloses a body turning apparatus. This apparatus does not use any endless conveyors to accomplish the task at hand.

Applicant's own U.S. Pat. No. 6,711,759 discloses a complete system for picking up a patient at point A and transporting the patient to a point B. The pick-up device in this invention has been modified to simplify its operation.

BRIEF SUMMARY OF THE INVENTION

An object of the invention is a lifting device that can easily pick up a patient without having to move the patient, lift the patient and transport the patient by either an overhead conveyor mechanism or any apparatus that is movable on the ground. The above task is accomplished without any human intervention such as lifting or turning. A conveyor system simply moves two opposing devices under the patient while the patient is in a sitting or recumbent position. The two opposing devices move toward each other below the patient and form a comfortable seat by which the patient is lifted and transported.

DETAILED DESCRIPTION OF THE INVENTION

Figure 1:
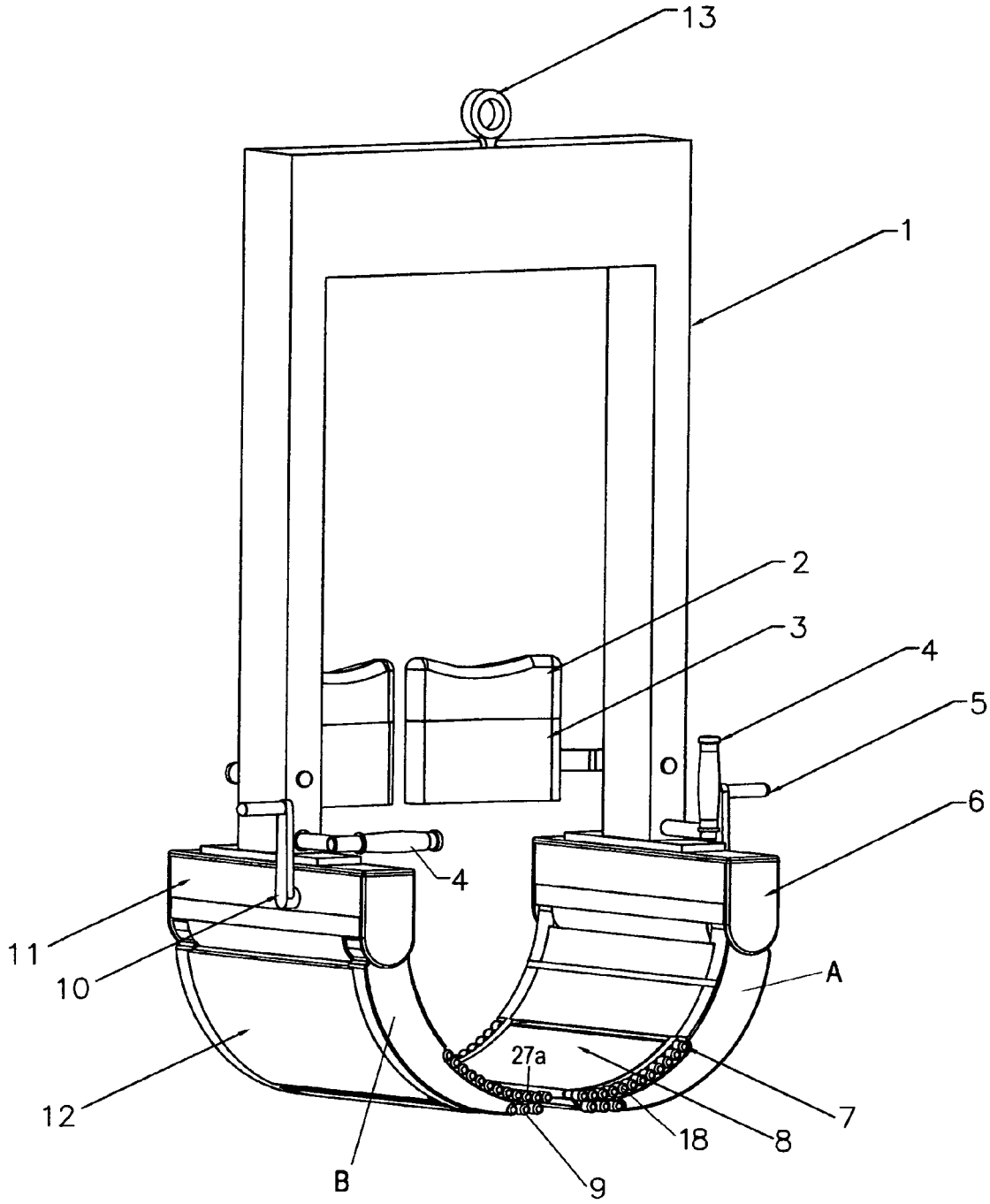
FIG. 1 is a perspective view of the patient pick-up system in a closed or patient pick-up position.
Figure 3:
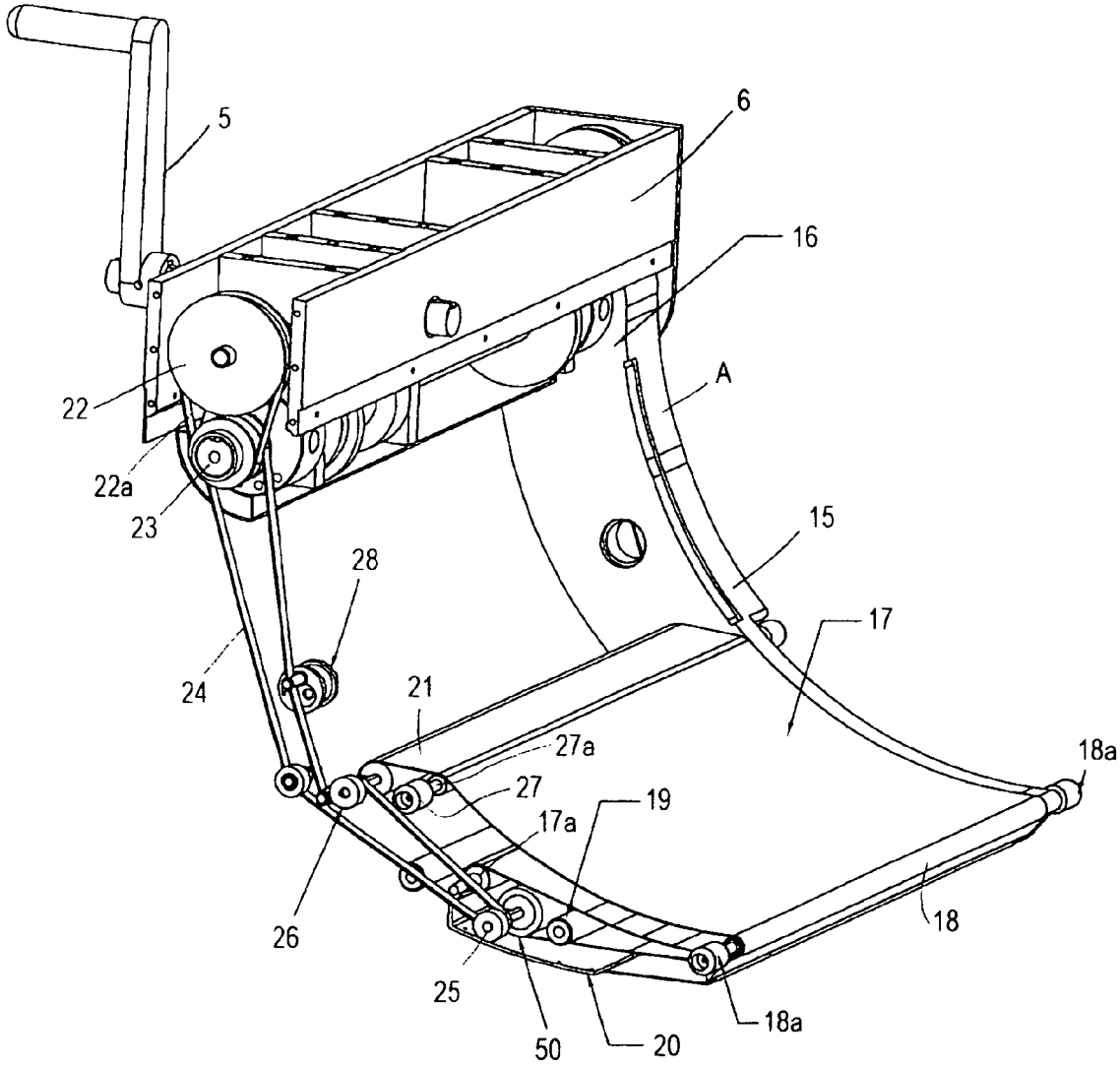
FIG. 3 is a perspective view of the conveyor driving mechanism using a belt drive including the conveyor runs.

FIG. 1 is a perspective view of the inventive patient pick-up device as it is shown mounted to a support frame which in turn will be mounted to a ceiling track by way of the support ring 13. The track (not shown) has a dolly running thereon which will transport the patient pick-up device mounted thereon at 13 to various locations. Once a patient is sitting on the device, there are upper and lower backrests 2 and 3 to support the back of the patient. The back supports 2 and 3 can be moved out of the way if the patient is to be transported in a recumbent position. On the support frame there are mounted pivotal handles 4 as safety measures for the patient. At 5 there are shown crank handles 5, described below. At 6 and 11 there are shown gear boxes through which the conveyors are operated (shown and explained below). At 7 there are shown edge rollers on the right side frame member and edge rollers 9 on the left side frame member B. Both edge rollers on either side of the frame members A and B are connected by rods 27*a* to give support to the conveyor belt 17 (FIG. 3). The rods 27*a* including the edge guide rollers 18*a* and 27 are closely spaced relative to each other in order to give full support for a patient placed on the conveyor belt 17. All the guide rollers 18*a* (FIG. 3) and 27 are stationarly mounted in both the left and right frame members 15 or A and B.

Figure 2:
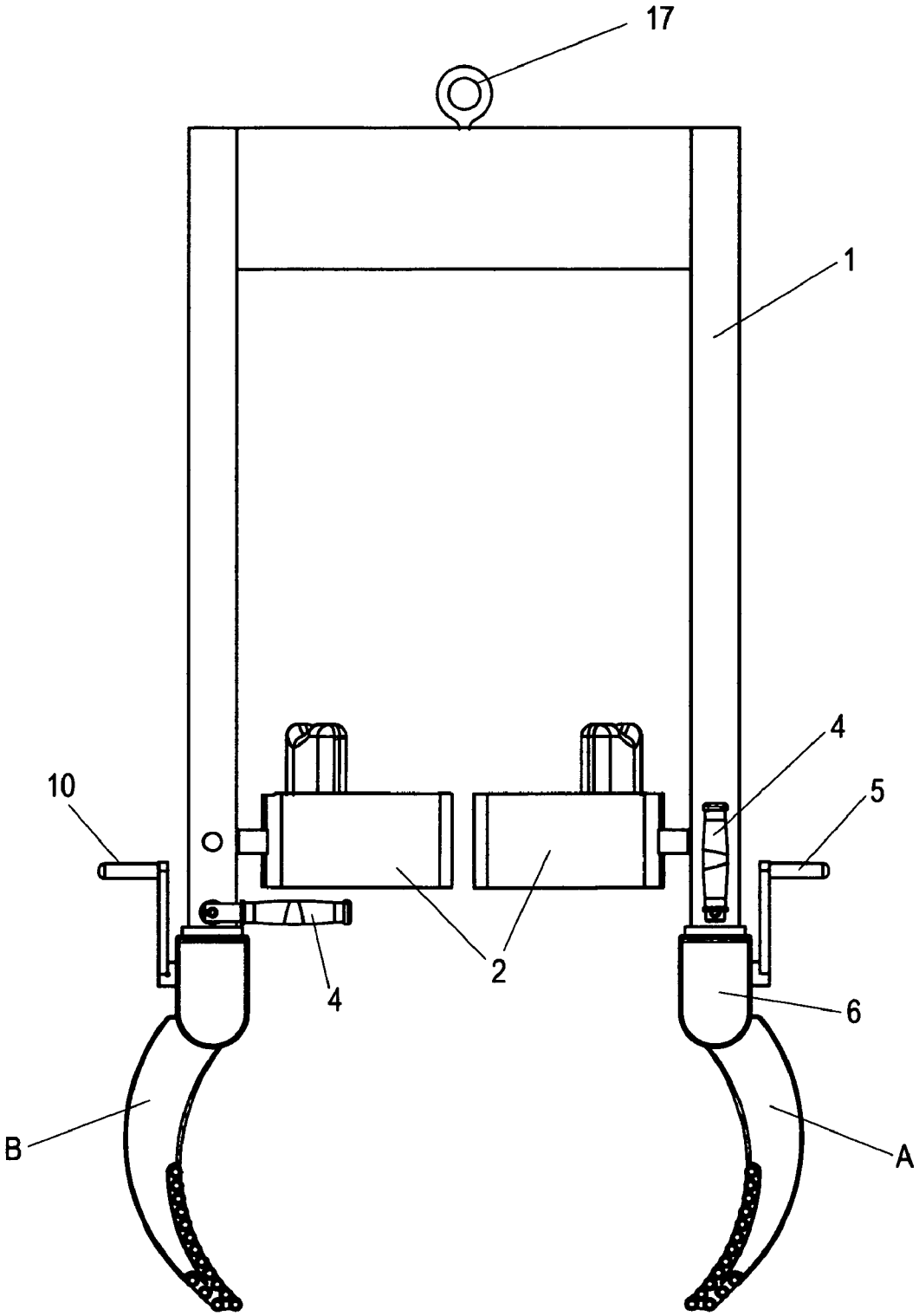
FIG. 2 is a frontal view of the system of FIG. 1 in an open position.

FIG. 2 is a frontal view of the device shown in FIG. 1 with the same reference characters having been applied. In this view the frame members A and B are shown in an open position.

FIG. 3 illustrates, as an example, the right frame member A or 15 with its various components mounted thereon. Like reference characters that were used in FIG. 1 are again shown in this FIG. 3. The gear box 6 is shown in an open position and shows the hand crank 5. It also shows a driving belt pulley 22 which is driven by a belt 22*a* which in turn drives the driven belt pulley 23. This driven belt pulley 23 drives a belt 24 which in turn drives the pulley 25. The pulley 25 is connected to a shaft onto which is mounted the take-up roller or reel 20. An intermediate run of the belt is trained over the pulley 26. This pulley 26 drives a shaft of a take-up reel 21. The operation of the take-off reel 21 and take-up reel 50 will be explained below. There is belt tension device at 28 which will regulate the tension on the belt 24. The conveyor belt run starts, as an example, at the reel 21 and continues forward to a front return roller 18 and then is trained backward to a return roller 17*a* and then forward again where there is another return roller (not shown) to be trained backward again to finally arrive at the reel 50. In operation, when the hand crank 5 (or an electric motor explained below) is operated, the frame member A or 15 is moved forward under the patient. At the same time the conveyor belt 17 is operated at the same ratio of movement as the frame member A or 15. The upper run of the conveyor belt runs backward and under the patient while the take-up reel 20 reels in the fabric of the conveyor belt 17. Of course, the frame member B on the other side operates in the same manner. Once the movement of both the frame members A and B is completed, the patient will securely sit on the conveyor belt and can be transported to another location by way of the ceiling mounted dolly (not shown). When the patient arrives at the destination, the hand cranks 5 (or electric motors) are operated in a reverse direction whereby the take-up reel 50 becomes the take-off reel 21 and the take-off reel becomes the take-up reel. Thereby the direction of the movement of the conveyor is reversed, the frame members A and B move away from each other and will release the patient at the predetermined destination.

Figure 4:
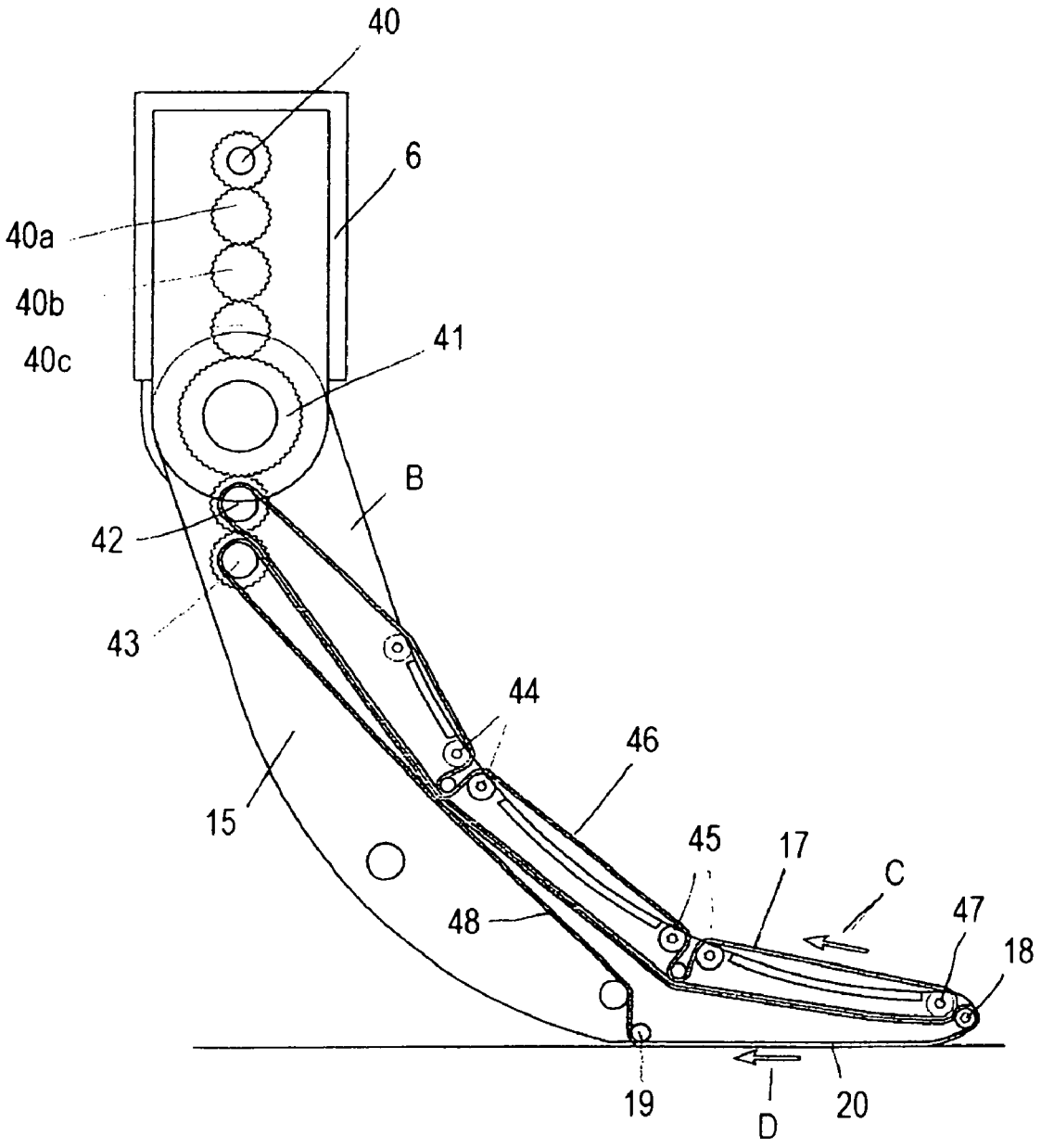
FIG. 4 is a side view of the driving mechanism using gear drives.

FIG. 4 shows a different drive mechanism for the belt system. This drive mechanism is operated by gear wheels instead of the belts as were shown and explained in FIG. 3. The gear box 6 has a driving gear wheel 40 which in turn will drive the gear wheel 41 by way of the intermediate gear wheels 40*a*–40*c*. The gear wheels 42 and 43 are driven by the gear wheel 41 but in opposite directions. The 42 drives a first endless conveyor belt 46 around a front return roller and back to the gear wheel 42. The gear wheel 43 drives a second endless conveyor belt 48 to a return front roller 18 whereby the belt 48 will be returned and continues under the bottom plate 20 over the support rod 21 and back around a reverse roller which is driven by the gear wheel 43. In operation, when the driven gear wheel 41 is driven in a counterclockwise direction, the endless conveyor belt is driven in the direction as is indicated by the arrow C and the other endless conveyor belt 48 is driven in the direction of arrow D. Thereby, the patient will be conveyed onto the upper conveyor belt as the frame member B moves under the patient aided by the movement of the lower or second endless conveyor belt 48 in the direction of arrow D and around the bottom plate 20. Of course, the reverse happens when the gear wheel 41 is driven in a clockwise direction whereby the patient is released again.

Figure 5:
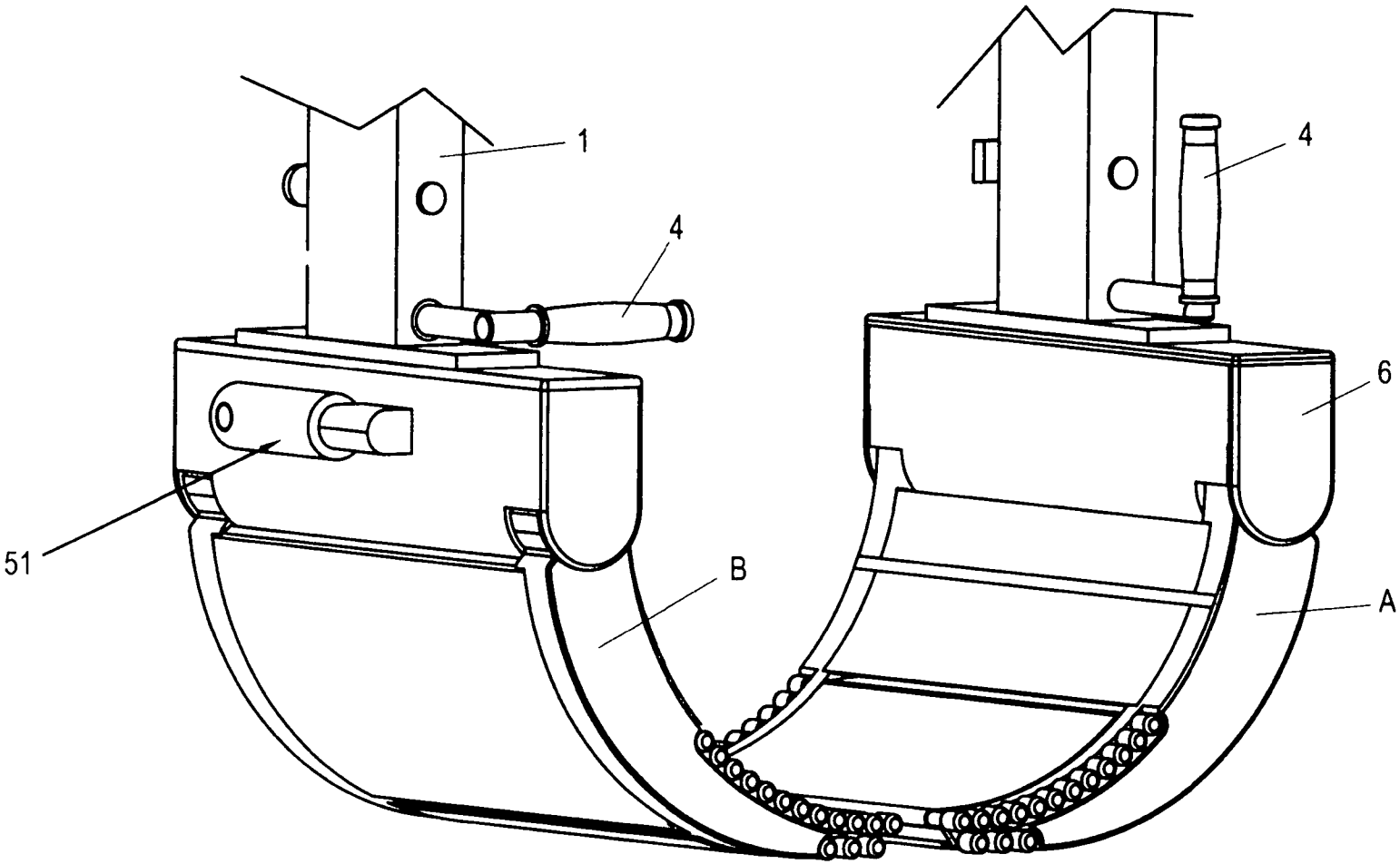
FIG. 5 illustrates an electric motor drive instead of a hand crank.

FIG. 5 is a different embodiment for the drive of the belts and the frame members A and B. Instead of using the hand cranks 5, as shown in prior Figs., an electric motor 52 is being used. There is one motor 51 on each side of the gear box. This way, the patient or an attendant can activate the system from a remote location.

What is claimed is:

1. An invalid person transfer system comprising a movable suspended frame having lateral support columns, each of said columns having at a lower end thereof a gear box having ends, each of said gear boxes having at each of their ends pivotal frame members attached thereto, said frame members being connected by a multiple of rods having end rollers, conveyor belts are operating between each of said frame members, means for driving said conveyor belts from said gear boxes in two different directions around front reversing rollers, whereby, when said conveyor belts are operated, said conveyor belts will move under a patient with the aid of said pivotal frame members.

2. The transfer system of claim 1, wherein said means for driving are endless belt drives trained over pulleys.

3. The transfer system of claim 2, wherein one of said pulleys drives a conveyor belt take-up reel and another of said pulleys drives a conveyor belt let-off reel, said conveyor belt is driven around said front reversing roller.

4. The transfer system of claim 1, wherein said means for driving are gear wheels interconnected between said gear box and said conveyor belts.

5. The transfer system of claim 4, wherein one of said gear wheels drives a first endless conveyor belt around said front reversing roller in one direction and another of said gear wheels drives a second endless conveyor belt around another of said front reversing rollers in an opposite direction.

6. The transfer system of claim 1 including hand cranks attached to said gear boxes for driving said conveyor belts.

7. The transfer system of claim 1 including electric motors attached to said gear boxes for driving said conveyor belts.

8. The transfer system of claim 1 including pivotal back rests for supporting a back of a patient once seated on said conveyor belts.

9. The transfer system of claim 1 including a bottom located above a lower run of said conveyor belt to aid said frame members including said conveyor belts in sliding under a patient.

* * * * *

UNITED STATES PATENT AND TRADEMARK OFFICE
Certificate

Patent No. 6,971,126 B1

Patented: December 6, 2005

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Gary R. Kluckhuhn, Naples, FL (US); and Frederick F. Ferderber, Oldsmar, FL (US).

Signed and Sealed this Ninth Day of June 2009.

PETER M. CUOMO
*Supervisory Patent Examiner*
Art Unit 3673